US006035945A

United States Patent [19]

Ichijyou et al.

[11] Patent Number: 6,035,945

[45] Date of Patent: Mar. 14, 2000

[54] OPERATING MODE SWITCHING APPARATUS FOR A HAMMER DRILL

[75] Inventors: Toshihiro Ichijyou, Hitachinaka; Yukio Terunuma, Hitachi, both of Japan

[73] Assignee: Hitachi Koki Co., Ltd., Tokyo, Japan

[21] Appl. No.: 09/014,706

[22] Filed: Jan. 28, 1998

[30] Foreign Application Priority Data

Apr. 18, 1997 [JP] Japan ..... 9-101770

[51] Int. Cl.[7] ..... B25D 11/04

[52] U.S. Cl. ..... 173/48; 173/109; 173/201

[58] Field of Search ..... 713/48, 47, 201, 713/109, 200

[56] References Cited

U.S. PATENT DOCUMENTS 5,320,177 6/1994 Shibata et al. ..... 173/48
5,435,397 7/1995 Demuth ..... 173/48

FOREIGN PATENT DOCUMENTS 1-240208 8/1989 Japan ..... 173/48
2-24072 1/1990 Japan ..... 173/48
3-504697 10/1991 Japan .

*Primary Examiner*—Peter Vo
*Assistant Examiner*—Jim Calve
*Attorney, Agent, or Firm*—McDermott, Will & Emery

[57] ABSTRACT

A second pinion is rotatably supported around an intermediate shaft and slidable in an axial direction of the intermediate shaft. A pinion sleeve is fixed to the intermediate shaft. A first clutch mechanism selectively engages and disengages the second pinion with and from the pinion sleeve to selectively transmit and interrupt a rotational force of a motor to a tool attached on a front end of a hammer drill. A sleeve is supported around the intermediate shaft so as not to be rotatable about the intermediate shaft but slidable in the axial direction of the intermediate shaft. A motion converting member is rotatably supported around the intermediate shaft. The motion converting member converts the rotational force of the motor into the percussion force. A second clutch mechanism selectively engages and disengages the motion converting member with and from the sleeve to selectively transmit and interrupt the percussion force to the tool.

5 Claims, 6 Drawing Sheets

ROTATION + PERCUSSION

ROTATION + PERCUSSION

NEUTRAL

PERCUSSION ONLY

ROTATION ONLY

ROTATION + PERCUSSION

NEUTRAL

PERCUSSION ONLY

ROTATION ONLY

OPERATING MODE SWITCHING APPARATUS FOR A HAMMER DRILL

BACKGROUND OF THE INVENTION

The present invention relates to an operating mode switching apparatus for a hammer drill which comprises a percussion mechanism as well as a rotational force transmitting mechanism.

For example, a conventional hammer drill is equipped with a motor. The motor causes a rotational force for driving a tool attached on a front end of the hammer drill. The rotational force of the motor is transmitted to an intermediate shaft via a first pinion and a first gear. A second pinion is provided on the intermediate shaft. The second pinion meshes with a second gear. Thus, the rotational force of the motor is always transmitted to the second gear. The second gear meshes with a rotary cylinder. A rotational force of the second gear is thus transmitted to the tool attached on the front end of the hammer drill via the rotary cylinder.

The intermediate shaft is a castellated portion for spline engagement with a sleeve. This sleeve is selectively engageable with a motion converting member. The motion converting member is coupled around and rotatable about the intermediate shaft. When the sleeve is engaged with the motion converting member, the rotational force of the motor is transmitted from the intermediate shaft to a piston via the motion converting member. The piston, acting like an air spring, reciprocates to cause a compression force which is transmitted as a percussion force to the tool via a percussion element and an appropriate intermediate element.

The operating mode of the hammer drill is changeable by manipulating a mode switching member which is, for example, rotatably provided on an outer casing of the hammer drill. The rotational motion of the mode switching member is linked with the sliding motion of the sleeve. When the mode switching member is rotated by an operator, the sleeve shifts in the axial S direction to change the engaging condition between the sleeve and the motion converting member. Thus, the operating mode of the hammer drill is changeable depending on the preference of the operator. For example, both of the rotational force and the percussion force can be transmitted to the tool in one mode. Only the rotational mode can be transmitted to the tool in another mode by manipulating the switching member.

Unexamined Japanese Patent Application No. 3-504697, corresponding to PCT/DE89/00336 (WO89/11955), published in 1991, discloses a hammer drill having three modes of "rotation+percussion", "rotation only" and "percussion only" which are arbitrarily selectable depending on user's preference.

SUMMARY OF THE INVENTION

An object of the present invention is to provide a novel and excellent operating mode switching apparatus for a hammer drill which is easy to operate and simple and/or compact in construction.

In order to accomplish this and other related objects, the present invention provides a hammer drill having various aspects which will be described hereinafter. Reference numerals in parentheses, added in the following description, show the correspondence to the components disclosed in preferred embodiments of the present invention, and are therefore merely used for expediting the understanding to the present invention and not used for narrowly interpreting the scope of the present invention.

According to one aspect of the present, the hammer drill has a motor (1), a rotation transmitting mechanism transmitting a rotational force to a tool (20) attached to the hammer drill, and a percussion mechanism transmitting a percussion force to the tool. More specifically, in the rotation transmitting mechanism, a pinion (10) is rotatably supported around an intermediate shaft (14) and slidable in an axial direction of the intermediate shaft. A first sleeve (12) is fixed to the intermediate shaft. And, a first clutch mechanism (11) selectively engages the pinion with the first sleeve to transmit a rotational force of the motor to the tool (20) and disengages the pinion from the first sleeve to interrupt the transmission of the rotational force to the tool. Furthermore, in the percussion mechanism, a second sleeve (6) is supported around the intermediate shaft so as not to be rotatable about the intermediate shaft but slidable in the axial direction of the intermediate shaft. A motion converting member (4) is rotatably supported around the intermediate shaft. The motion converting member converts the rotational force of the motor into the percussion force. And, a second clutch mechanism (5) selectively engages the motion converting member with the second sleeve to transmit the percussion force to the tool and disengages the motion converting member from the second sleeve to interrupt the transmission of the percussion force to the tool.

Preferably, the hammer drill further comprises a first spring (7) interposed between the second sleeve (6) and the pinion (10). The first spring resiliently urges both of the second sleeve and the pinion. A rotation restricting member (9) is slidable in the axial direction of the intermediate shaft to shift the pinion (10) and the second sleeve (6). And, a second spring (23) resiliently urges the rotation restricting member (9).

Preferably, the pinion (10) is shifted in a predetermined direction when the transmission of the rotational force is interrupted by the first clutch mechanism (11) while the second sleeve (6) is shifted in an opposed direction when the transmission of the percussion force is interrupted by the second clutch mechanism (5).

Preferably, the hammer drill further comprises a third clutch mechanism (22) for engaging the rotation restricting member (9) with the pinion (10).

Preferably, the hammer drill further comprises a switching member (8) sidably provided on an outer casing (21). The switching member has an inner portion **(8*a*) linked with the rotation restricting member (9)** for allowing an operator to change an operating mode by manipulating the switching member.

Preferably, the rotational force of the motor (1) is transmitted to one end of the intermediate shaft (14) while the first sleeve (12) is fixed to the other end of the intermediate shaft.

Preferably, the first sleeve (12) has an internal gear **(12*a*) meshing with a pinion portion (10*a*) of the pinion (10) when the first clutch mechanism (11)** is engaged.

Preferably, the pinion (10) transmits the rotational force via a gear (15) to a cylinder (19) supporting the tool (20).

Preferably, the rotation restricting member (9) is securely fixed on an inside wall of an outer casing (21).

Preferably, the rotation restricting member (9) has a stopper recess **(9*b*) which just fits to and is engageable with a gear (10*b*) formed at an annulus portion of the pinion (10)**.

Preferably, the rotation restricting member (9) has an engaging portion **(9*a*) abutting the second sleeve (6) being resiliently urged by the first spring (7)**.

Preferably, the rotation restricting member (9) is resiliently urged by the second spring (23) so that the rotation restricting member (9) always abuts the inner portion (8*a*) of the switching member (8).

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
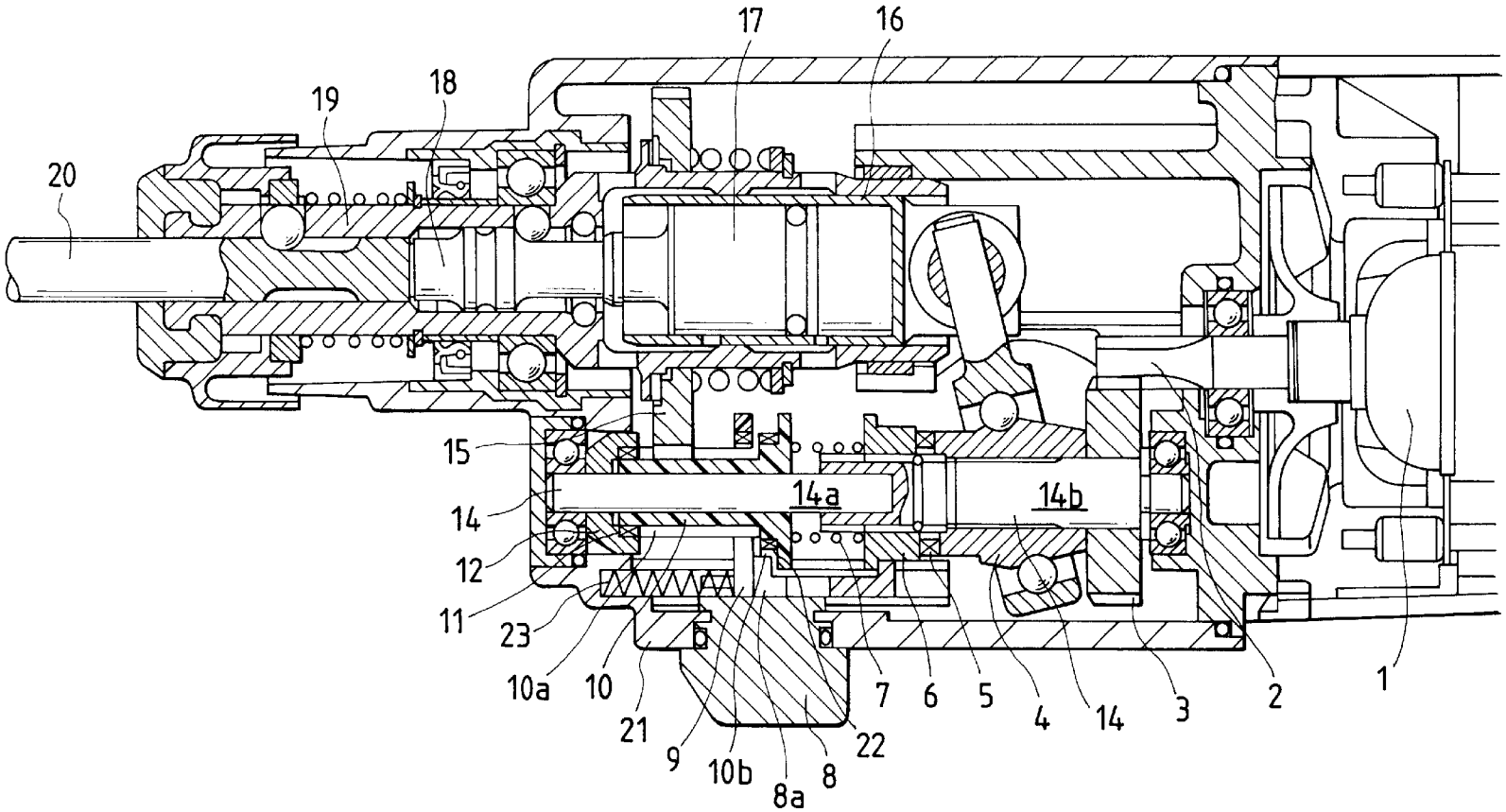
FIG. 1 is a vertical cross-sectional view showing an overall arrangement of a hammer drill in a "rotation plus percussion" mode of a preferred embodiment of the present invention.

A preferred embodiment of the present invention will be explained with reference to FIGS. 1 through 12. Identical parts are denoted by the same reference numerals throughout the views.

A motor 1 serving as a driving source of a hammer drill. A motion converting member 4 converts a rotational force of the motor 1 into a percussion force. The percussion force is transmitted by a percussion mechanism to a tool 20 attached at a front end of the hammer drill. Meanwhile, a rotation transmitting mechanism transmits the rotational force of the motor 1 to the tool 20. A cylinder 19 supports the tool 20. A second pinion 10 transmits the rotational force to the cylinder 19 via a second gear 15. The second pinion 10 is coaxially coupled around an intermediate shaft 14*a* so as to be rotatable about an axis of the intermediate shaft 14*a* and shiftable in the axial direction.

A pinion sleeve 12 is press fitted to and securely fixed with a front end of the intermediate shaft 14*a* adjacent to a front end of the second pinion 10. The pinion sleeve 12 has an internal gear 12*a* meshing with a pinion portion 10*a* of the second pinion 10. The intermediate shaft 14*a* is press fitted to and securely fixed with another intermediate shaft 14*b*. Thus, the intermediate shaft 14*a* rotates integrally with the intermediate shaft 14*b*. The intermediate shafts 14*a* and 14*b* are collectively referred to as intermediate shaft 14.

When the pinion section 10*a* of the second pinion 10 engages with the internal gear 12*a* of the pinion sleeve 12, a rotational motion of the intermediate shaft 14*a* is transmitted to the second pinion 10 via the pinion sleeve 12. The rotational motion of the second pinion 10 is then transmitted to the tool 20 via the second gear 15 and the cylinder 19.

Figure 6:
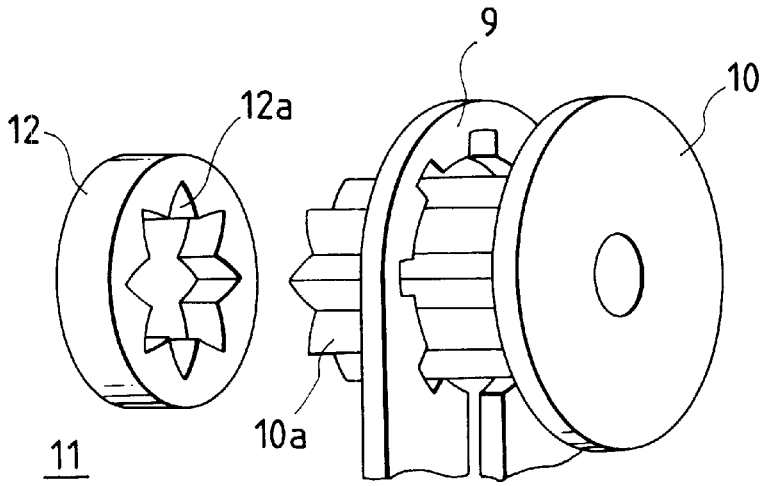
FIG. 6 is a perspective view showing a first clutch mechanism in accordance with the preferred embodiment of the present invention.

When the second pinion 10 shifts toward the motor 1 (i.e., rearward), the second pinion 10 disengages from the pinion sleeve 12. The intermediate shaft 14*a* slips in a cylindrical bore of the second pinion 10. Thus, no rotational force is transmitted to the cylinder 19. In other words, as shown in FIG. 6, engagement and/or disengagement of the second pinion 10 and the pinion sleeve 12 is controlled by a first clutch mechanism 11.

A cylindrical sleeve 6 has a castellated portion for spline engagement with the intermediate shaft 14*b*. The sleeve 6 is coaxially coupled around the intermediate shaft 14*b* and slidable in the axial direction of the intermediate shaft 14*b*, allowing no mutual rotation therebetween. The motion converting member 4 loosely couples around the intermediate shaft 14*b* and is rotatable about the axis of the intermediate shaft 14*b*. The sleeve 6 is selectively engageable with the motion converting member 4. When the sleeve 6 engages with the motion converting member 4, the rotational motion of the intermediate shaft 14*b* is transmitted to the motion converting member 4 via the sleeve 6. The motion converting member 4 converts the rotational motion into a percussion motion.

When the sleeve 6 shifts toward the tool 20 (i.e., forward), the sleeve 6 disengages from the motion converting member 4. Thus, the transmission of the percussion motion is interrupted. In other words, engagement and/or disengagement of the sleeve 6 and the motion converting member 4 is controlled by a second clutch mechanism 5.

Figure 8:
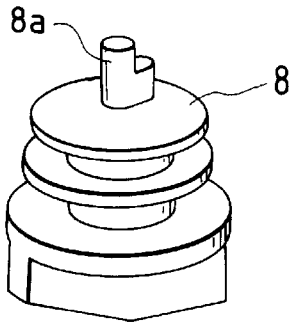
FIG. 8 is a perspective view showing a switching member in accordance with the preferred embodiment of the present invention.

A first spring 7 is interposed between the second pinion 10 and the sleeve 6 around the intermediate shaft 14. The first spring 7 resiliently urges the second pinion 10 and the sleeve 6 in opposite directions to bring each of the first clutch mechanism 11 and the second clutch mechanism 5 into an engaged condition. A switching member 8 controls the engagement and/or disengagement condition of each of the first clutch mechanism 11 and the second clutch mechanism 5. The switching member 8 is provided slidably on an outer casing 21. An operator can slide the switch member 8 to change the operating mode of the hammer drill. FIG. 8 shows the details of the switching member 8.

Figure 5:
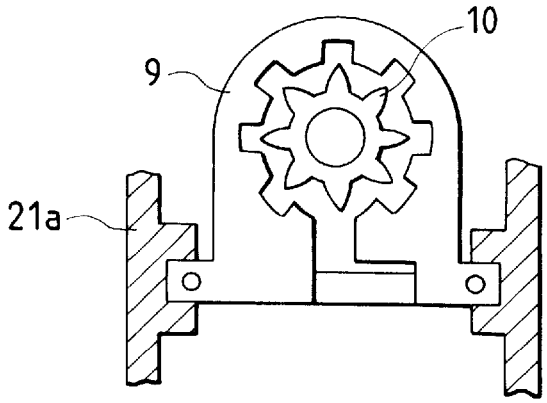
FIG. 5 is a view showing a rotation restricting member in accordance with the preferred embodiment of the present invention.
Figure 7:
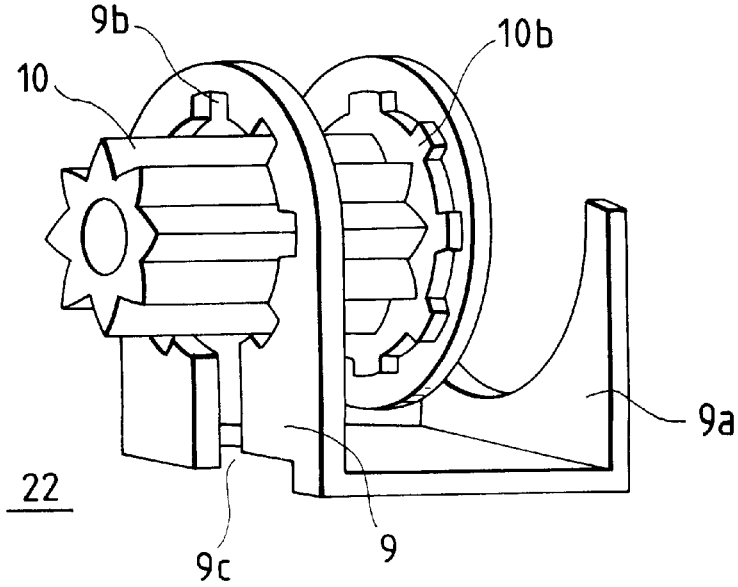
FIG. 7 is a perspective view showing a third clutch mechanism in accordance with the preferred embodiment of the present invention.

A rotation restricting member 9, whose details are shown in FIG. 5, is securely fixed in grooves 21*a* formed on the inside wall of the outer casing 21. The rotation restricting member 9 has a stopper recess 9*b* which just fits to and is engageable with a gear 10*b* formed at an annulus portion of the second pinion 10. The engagement between the rotation restricting member 9 and the gear 10*b* is linked with an axial shift motion of the second pinion 10 in accordance with the engaging and/or disengaging operation of the first clutch mechanism 11. When the stopper recess 9*b* of the rotation restricting member 9 engages with the gear 10*b* of the second pinion 10, the rotational motion of the cylinder 19 is locked. In other words, engagement and/or disengagement of the rotation restricting member 9 and the second pinion 10 is controlled by a third clutch mechanism 22 whose details are shown in FIG. 7. A second spring 23 resiliently urges the rotation restricting member 9 toward the motor 1 (i.e., rearward). Thus, the rotation restricting member 9 always abuts a projection 8*a* of the switching member 8.

Net an operation of the hammer drill in each mode will be explained.

Rotation plus Percussion

Figure 9:
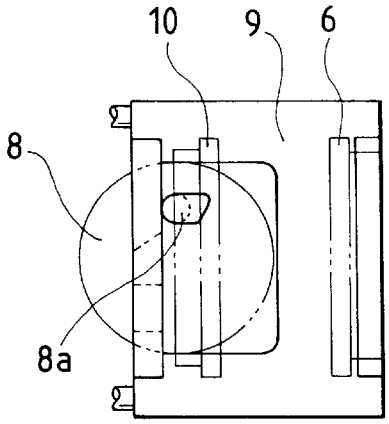
FIG. 9 is a plan view showing a switching condition in the "rotation plus percussion" mode in accordance with the preferred embodiment of the present invention.

In FIGS. 1 and 9, the rotation of the motor 1 is transmitted to the intermediate shaft 14*b* via a first pinion 2 and a gear 3. The sleeve 6 is slidably engaged with the intermediate shaft 14*b* by spline. The sleeve 6 is resiliently urged by the first spring 7 and positions at a predetermined home position where the second clutch mechanism 5 is in an engaged condition. Thus, the sleeve 6 engages with the motion converting member 4 via the second clutch mechanism 5. The motion converting member 4 causes a piston 16 to reciprocate so as to act as an air spring. The reciprocative movement of the piston 16 is transmitted as a percussion force to the tool 20 via a percussion element 17 and an intermediate element 18. Meanwhile, the rotation of the motor 1 is transmitted from the intermediate shaft 14*a* to the second pinion 10 via the first clutch mechanism 11. The rotation of the second pinion 10 is then transmitted to the cylinder 19 via the second gear 15. The tool 20 rotates integrally with the cylinder 19. Thus, the tool 20 receives both of the percussion force and the rotational force simultaneously, thereby realizing a "rotation plus percussion" mode as one of operation modes.

Neutral

Figure 2:
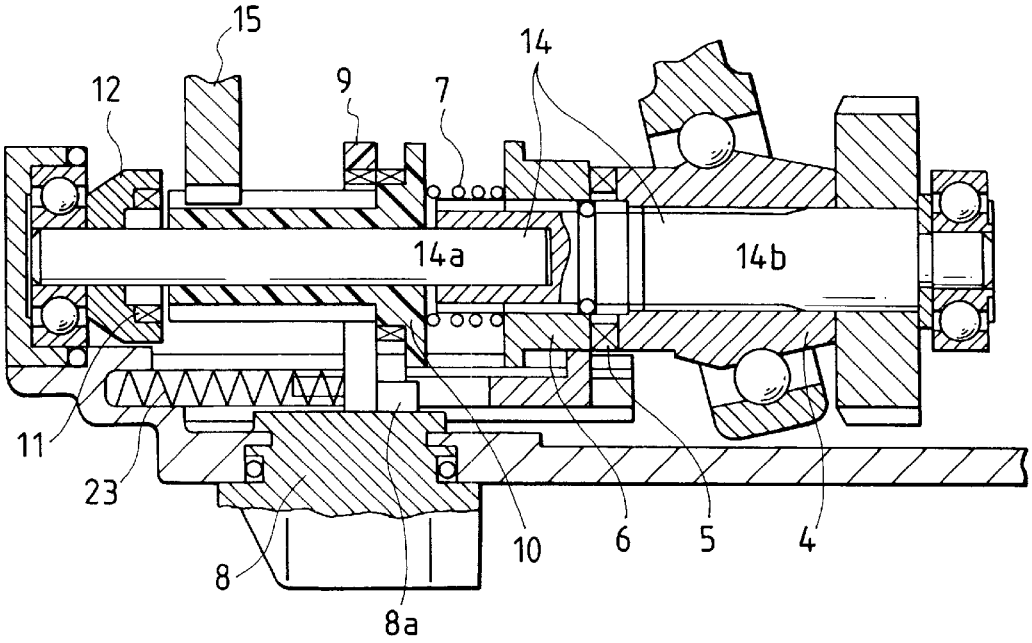
FIG. 2 is a vertical cross-sectional view showing a "neural" mode of the hammer drill in accordance with the preferred embodiment of the present invention.
Figure 10:
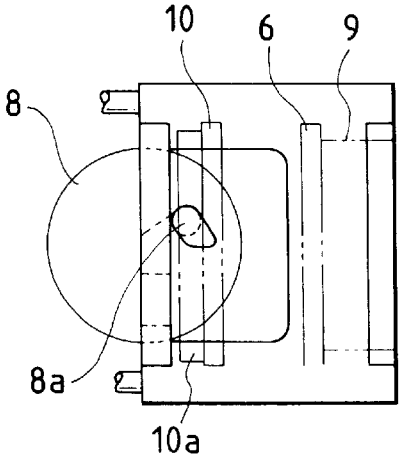
FIG. 10 is a plan view showing a switching condition in the "neutral" mode in accordance with the preferred embodiment of the present invention.

In FIGS. 2 and 10, to change the "rotation plus percussion" mode to a "neutral" mode, the operator manipulates the switching member 8 provided on the outer casing 21. More specifically, the projection 8*a* of the switching member 8 shifts the second pinion 10 toward the motor 1. Thus, the first clutch mechanism 11 disengages the second pinion 10 from the pinion sleeve 12.

The rotation restricting member 9 is resiliently urged by the second spring 23 so that the rotation restricting member 9 abuts the projection 8*a* of the switching member 8. The gear 10*b* of the second pinion 10 is not yet engaged with the stopper recess 9*b* of the rotation restricting member 9 in this condition. Accordingly, no rotational force is transmitted to the tool 20 and therefore the tool slips, thereby realizing the "neutral" mode as one of the operation modes. In this neutral mode, the direction of the tool 20 can be adjusted arbitrarily.

Percussion Only

Figure 3:
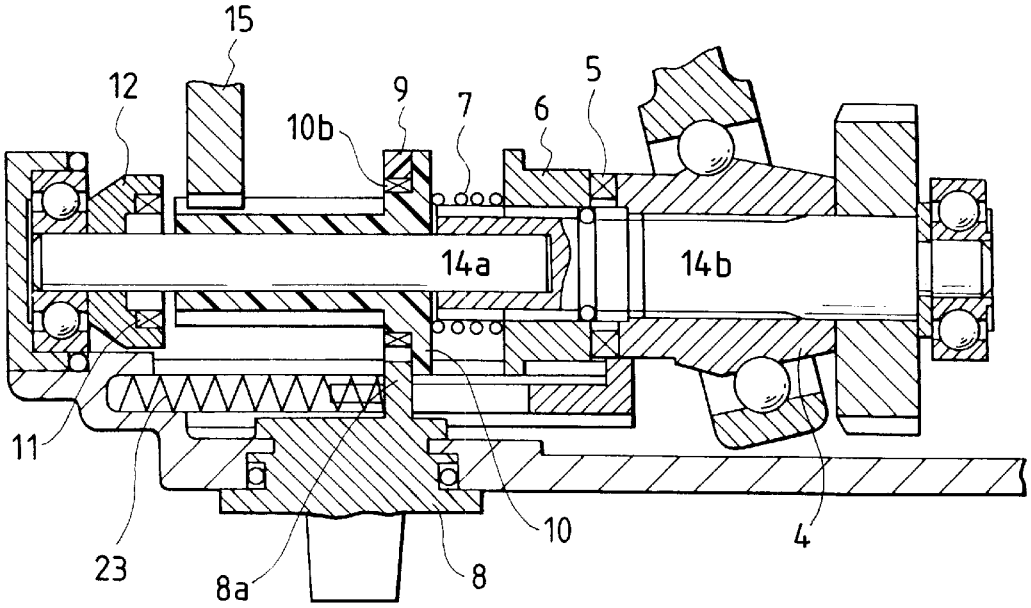
FIG. 3 is a vertical cross-sectional view showing a "percussion only" mode of the hammer drill in accordance with the preferred embodiment of the present invention.
Figure 11:
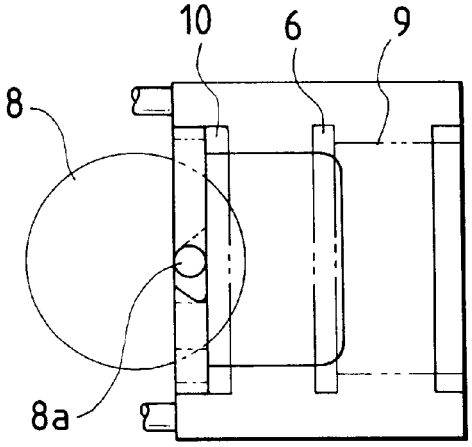
FIG. 11 is a plan view showing a switching condition in the "percussion only" mode in accordance with the preferred embodiment of the present invention.

In FIGS. 3 and 11, to change the "neutral" mode to a "percussion only" mode, the operator manipulates the switching member 8 to shift the projection 8*a* of the switching member 8 further toward the motor 1. The projection 8*a* of the switching member 8 enters an opening 9*c* of the rotation restricting member 9 shown in FIG. 7. With this further shift movement of the projection 8*a* of the switching member 8, the stopper recess 9*b* of the rotation restricting member 9 engages with the gear 10*b* of the second pinion 10. In other words, the third clutch mechanism 22 is brought into an engaged condition. This makes it possible to stop the tool 20 slipping. The sleeve 6 is resiliently urged by the first spring 7, so as to maintain the second clutch mechanism 5 in the engaged condition. Accordingly, the rotational force of the motor 1 is transmitted to the tool 20 as a percussion force via the intermediate shaft 14*a*, the second clutch mechanism 5, the motion converting member 4, the piston 16, the percussion element 17 and the intermediate element 18, thereby realizing the "percussion only" mode as one of the operating modes. As shown in FIGS. 5 through 7, an inner diameter of the rotation restricting member 9 is larger than an outer diameter of the second pinion 10.

Figure 4:
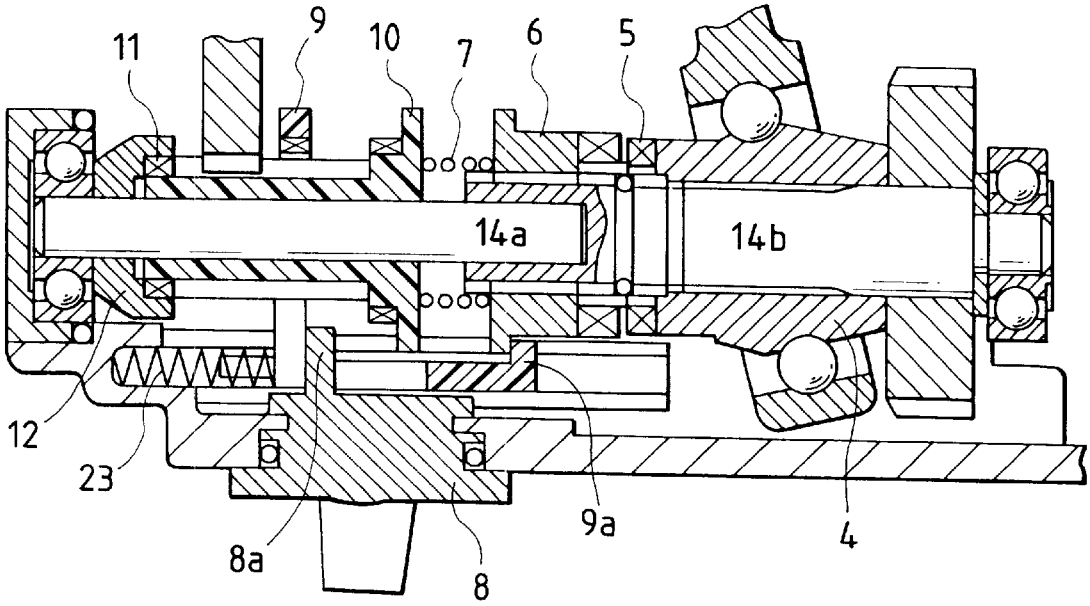
FIG. 4 is a vertical cross-sectional view showing a "rotation only" mode of the hammer drill in accordance with the preferred embodiment of the present invention.

When the second clutch mechanism 5 is in a disengaged condition, the operator manipulates the switching member 8 to shift the projection 8*a* toward the motor 1. The rotation restricting member 9, resiliently urged by the second spring 23, abuts the projection 8*a*. The rotation restricting member 9 shifts toward the motor 1 together with the projection 8*a*. The sleeve 6, resiliently urged by the first spring 7, abuts an engaging portion 9*a* of the rotation restricting member 9 as shown in FIG. 4. The shifting motion of the sleeve 6 toward the motor 1 is substantially restricted by the engaging portion 9*a* of the rotation restricting member 9. The sleeve 6 can thus shift toward the motor 1 only when the engaging portion 9*a* of the rotation restricting member 9 shifts toward the motor 1. Thus, in response to the manipulation of the switching member 8, the second clutch mechanism 5 is brought into an engaged condition. This realizes the "percussion only" mode via the "rotation plus percussion" mode.

Rotation Only

Figure 12:
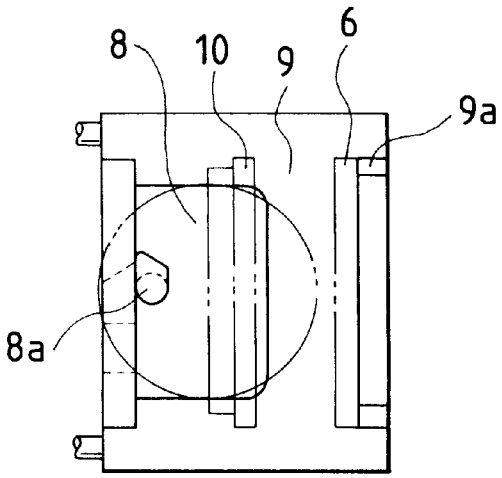
FIG. 12 is a plan view showing a switching condition in the "rotation only" mode in accordance with the preferred embodiment of the present invention.

In FIGS. 4 and 12, to change the "rotation plus percussion" mode to a "rotation only" mode, the operator manipulates the switching member 8 to shift the projection 8*a* of the switching member 8 in an opposite direction toward the tool 20. The rotation restricting member 9 shifts toward the tool 20. During this forward shift movement of the rotation restricting member 9, the engaging portion 9*a* of the rotation restricting member 9 abuts the sleeve 6. The sleeve 6 is shifted together with the rotation restricting member 9 toward the tool 20. Thus, the second clutch mechanism 5 disengages the sleeve 6 from the motion converting member 4. Thus, no percussion force is transmitted to the tool 20. The second pinion 10 is resiliently urged by the first spring 7. The first clutch mechanism 1 is maintained in the engaged condition. The rotational force of the motor 1 is transmitted to the tool 20 as a rotational force via the intermediate shaft 14*a*, the first clutch mechanism 11, the second gear 15 and the cylinder 19, thereby realizing the "rotation only" mode as one of the operating modes.

When the first clutch mechanism 11 is in a disengaged condition, the operator manipulates the switching member 8 to shift the projection 8*a* toward the tool 20. The second pinion 10, resiliently urged by the first spring 7, abuts the projection 8*a*. Thus, the second pinion 10 shifts toward the tool 20 together with the projection 8*a* to bring the first clutch mechanism 11 into an engaged condition. This realizes the "rotation only" mode via the "rotation plus percussion" mode.

The opening 9*c* of the rotation restricting member 9 has an widened entrance to realize a smooth switching from the "percussion only" mode to the "rotation plus percussion" mode.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A hammer drill having a motor, a rotation transmitting mechanism transmitting a rotational force to a tool attached to said hammer drill, and a percussion mechanism transmitting a percussion force to said tool, said rotation transmitting mechanism comprising:

a pinion disposed on an intermediate shaft so as to be rotatable about said intermediate shaft and slidable in an axial direction along said intermediate shaft;

a first sleeve fixed to said intermediate shaft; and a first clutch mechanism selectively engaging said pinion with said first sleeve to transmit a rotational force of said motor to said tool, and disengaging said pinion from said first sleeve to interrupt the transmission of the rotational force to said tool;

said percussion mechanism comprising:

a second sleeve supported around said intermediate shaft, said second sleeve being non-rotatable with respect to said intermediate shaft but slidable axially along said intermediate shaft;

a motion converting member rotatable supported on said intermediate shaft, said motion converting member converting the rotational force of said motor into the percussion force; and a second clutch mechanism selectively engaging said motion converting member with said second sleeve to transmit said percussion force to said tool, and disengaging said motion converting member from said second sleeve to interrupt the transmission of said percussion force to said tool, and said hammer drill further comprising:

a first spring interposed between said second sleeve and said pinion, said first spring applying a bias to both of said second sleeve and said pinion;

a rotation restricting member axially slidable along said intermediate shaft to shift said pinion and said second sleeve;

a second spring for applying a bias to said rotation restricting member; and a third clutch mechanism for engaging said rotation restricting member with said pinion.

2. A hammer drill having a motor, a rotation transmitting mechanism transmitting a rotational force to a tool attached to said hammer drill, and a percussion mechanism transmitting a percussion force to said tool, said rotation transmitting mechanism comprising:

a pinion disposed on an intermediate shaft so as to be rotatable about said intermediate shaft and slidable in an axial direction along said intermediate shaft;

a first sleeve fixed to said intermediate shaft; and a first clutch mechanism selectively engaging said pinion with said first sleeve to transmit a rotational force of said motor to said tool, and disengaging said pinion from said first sleeve to interrupt the transmission of the rotational force to said tool;

said percussion mechanism comprising:

a second sleeve supported around said intermediate shaft, said second sleeve being non-rotatable with respect to said intermediate shaft but slidable axially along said intermediate shaft;

a motion converting member rotatable supported on said intermediate shaft, said motion converting member converting the rotational force of said motor into the percussion force; and a second clutch mechanism selectively engaging said motion converting member with said second sleeve to transmit said percussion force to said tool, and disengaging said motion converting member from said second sleeve to interrupt the transmission of said percussion force to said tool, and said hammer drill further comprising:

a first spring interposed between said second sleeve and said pinion, said first spring applying a bias to both of said second sleeve and said pinion;

a rotation restricting member axially slidable along said intermediate shaft to shift said pinion and said second sleeve;

a second spring for applying a bias to said rotation restricting member; and further comprising a switching member slidably provided on an outer casing of the hammer drill, said switching member having an inner portion linked with said rotation restricting member for changing an operating mode by manipulating said switching member.

3. The hammer drill in accordance with claim 2, wherein said rotation restricting member is resiliently urged by said second spring so that said rotation restricting member always abuts said inner portion of said switching member.

4. A hammer drill having a motor, a rotation transmitting mechanism transmitting a rotational force to a tool attached to said hammer drill, and a percussion mechanism transmitting a percussion force to said tool, said rotation transmitting mechanism comprising:

a pinion disposed on an intermediate shaft so as to be rotatable about said intermediate shaft and slidable in an axial direction along said intermediate shaft;

a first sleeve fixed to said intermediate shaft; and a first clutch mechanism selectively engaging said pinion with said first sleeve to transmit a rotational force of said motor to said tool, and disengaging said pinion from said first sleeve to interrupt the transmission of the rotational force to said tool;

said percussion mechanism comprising:

a second sleeve supported around said intermediate shaft, said second sleeve being non-rotatable with respect to said intermediate shaft but slidable axially along said intermediate shaft;

a motion converting member rotatable supported on said intermediate shaft, said motion converting member converting the rotational force of said motor into the percussion force; and a second clutch mechanism selectively engaging said motion converting member with said second sleeve to transmit said percussion force to said tool, and disengaging said motion converting member from said second sleeve to interrupt the transmission of said percussion force to said tool, and said hammer drill further comprising:

a first spring interposed between said second sleeve and said pinion, said first spring applying a bias to both of said second sleeve and said pinion;

a rotation restricting member axially slidable along said intermediate shaft to shift said pinion and said second sleeve;

a second spring for applying a bias to said rotation restricting member; and wherein said rotation restricting member is slidably fixed on an inside wall of an outer casing.

5. A hammer drill having a motor, a rotation transmitting mechanism transmitting a rotational force to a tool attached to said hammer drill, and a percussion mechanism transmitting a percussion force to said tool, said rotation transmitting mechanism comprising:

a pinion disposed on an intermediate shaft so as to be rotatable about said intermediate shaft and slidable in an axial direction along said intermediate shaft;

a first sleeve fixed to said intermediate shaft; and a first clutch mechanism selectively engaging said pinion with said first sleeve to transmit a rotational force of said motor to said tool, and disengaging said pinion from said first sleeve to interrupt the transmission of the rotational force to said tool;

said percussion mechanism comprising:

a second sleeve supported around said intermediate shaft, said second sleeve being non-rotatable with respect to said intermediate shaft but slidable axially along said intermediate shaft;

a motion converting member rotatable supported on said intermediate shaft, said motion converting member converting the rotational force of said motor into the percussion force; and a second clutch mechanism selectively engaging said motion converting member with said second sleeve to transmit said percussion force to said tool, and disengaging said motion converting member from said second sleeve to interrupt the transmission of said percussion force to said tool, and said hammer drill further comprising:

a first spring interposed between said second sleeve and said pinion, said first spring applying a bias to both of said second sleeve and said pinion;

a rotation restricting member axially slidable alone said intermediate shaft to shift said pinion and said second sleeve;

a second spring for applying a bias to said rotation restricting member; and wherein said rotation restricting member has a stopper recess which, engages a gear formed at an annulus portion of said pinion.

* * * * *